US010593269B2

(12) United States Patent
Kim et al.

(10) Patent No.: US 10,593,269 B2
(45) Date of Patent: Mar. 17, 2020

(54) DATA DRIVER AND DISPLAY DEVICE HAVING THE SAME

(71) Applicants: Samsung Display Co., Ltd., Yongin-si, Gyeonggi-do (KR); Sogang University Research & Business Development Foundation, Seoul (KR)

(72) Inventors: Sang Kuk Kim, Seoul (KR); Moonsang Hwang, Seoul (KR); Weonjun Choe, Hwaseong-si (KR); Tai-Ji An, Seoul (KR); Seung-Hoon Lee, Seoul (KR); Won-Kang Kim, Gunpo-si (KR); Jun-Sang Park, Seoul (KR)

(73) Assignees: Samsung Display Co., Ltd., Yongin-si (KR); Sogang University Research & Business Development Foundation, Seoul (KR)

( * ) Notice: Subject to any disclaimer, the term of this patent is extended or adjusted under 35 U.S.C. 154(b) by 108 days.

(21) Appl. No.: 15/879,337

(22) Filed: Jan. 24, 2018

(65) Prior Publication Data

US 2018/0211605 A1 Jul. 26, 2018

(30) Foreign Application Priority Data

Jan. 25, 2017 (KR) ..... 10-2017-0012128

(51) Int. Cl.
*G09G 3/36* (2006.01)
*G09G 3/3275* (2016.01)

(52) U.S. Cl.
CPC ..... *G09G 3/3275* (2013.01); *G09G 3/3685* (2013.01); *G09G 3/3696* (2013.01);
(Continued)

(58) Field of Classification Search
CPC .. G09G 3/3275; G09G 3/3685; G09G 3/3696; G09G 2310/0264; G09G 2310/0243; G09G 2310/0259
(Continued)

(56) References Cited

U.S. PATENT DOCUMENTS 6,384,806 B1 * 5/2002 Matsueda ..... G09G 3/3688 345/89
7,675,497 B2 * 3/2010 Park ..... G09G 3/3688 345/89
(Continued)

FOREIGN PATENT DOCUMENTS

KR 10-2005-0006331 A 1/2005
KR 10-2005-0045168 A 5/2005
(Continued)

OTHER PUBLICATIONS

Kudo, Y. et al.; "Low power and high-integration driver IC for small-sized TFT-LCDs"; SID 03 Digest; 42.3; 2003; pp. 1244-1247.
(Continued)

*Primary Examiner* — Jennifer T Nguyen
(74) *Attorney, Agent, or Firm* — Lewis Roca Rothgerber Christie LLP

(57) ABSTRACT

A data driver includes a ramp signal generator generating a first ramp signal and a second ramp signal, a counter generating a count signal based on a clock signal, and channels each generating a data signal based on the first ramp signal, the second ramp signal, and the count signal. Each channel includes a latch circuit dividing the image data into a first partial data and a second partial data and latching the first and the second partial data, a duplication driver generating first and second reference signals by duplicating the first and second ramp signals, a digital-analog converter generating a driving signal corresponding to a first partial data based on the first and second reference signals, and an
(Continued)

output circuit sampling the driving signal by comparing the second partial data with the count signal to output the data signal.

15 Claims, 9 Drawing Sheets

(52) U.S. Cl.
CPC ..... *G09G 2310/027* (2013.01); *G09G 2310/0243* (2013.01); *G09G 2310/0259* (2013.01); *G09G 2310/0289* (2013.01); *G09G 2310/0291* (2013.01); *G09G 2310/0294* (2013.01); *G09G 2310/066* (2013.01); *G09G 2330/08* (2013.01)

(58) Field of Classification Search
USPC ..... 345/76–100
See application file for complete search history.

(56) References Cited

U.S. PATENT DOCUMENTS

2004/0135778 A1* 7/2004 Sato ..... G09G 3/3688 345/204
2005/0140595 A1* 6/2005 Yang ..... G09G 3/30 345/76
2006/0012698 A1* 1/2006 Nitta ..... H04N 3/155 348/308
2016/0189643 A1 6/2016 Uchiyama
2016/0308546 A1 10/2016 Chandra et al.
2016/0314841 A1 10/2016 Conte et al.

FOREIGN PATENT DOCUMENTS

KR 10-0727410 B1 6/2007
KR 10-2007-0082004 A 8/2007

OTHER PUBLICATIONS

Lu, Chih-Wen et al.; "A 10b Resistor-Resistor-String DAC with Current Compensation for Compact LCD Driver ICs"; ISSCC 2011; Session 17; Biomedical & Displays; 17.10; Feb. 22, 2011; 3pp.

Snoeij, M.F. et al.; "A CMOS Image Sensor with a Column-Level Multiple-Ramp Single-Slope ADC"; IEEE ISSCC 2007; Session 28, Image Sensors; 28.4; 3pp.

* cited by examiner

DATA DRIVER AND DISPLAY DEVICE HAVING THE SAME

CROSS REFERENCE TO RELATED APPLICATION

This application claims priority to and the benefit of Korean Patent Application No. 10-2017-0012128 filed on Jan. 25, 2017, the disclosure of which is hereby incorporated by reference herein in its entirety.

BACKGROUND

1. Field

Aspects of some example embodiments of the present invention relate to display devices.

2. Description of the Related Art

A display device includes a display panel and a panel driver. The display panel includes a plurality of scan lines, a plurality of data lines, and a plurality of pixels. The panel driver includes a scan driver providing the scan signal to the pixels via the scan lines and a data driver providing the data signal to the pixels via the data lines.

Generally, the data driver includes channels connected to the data lines, respectively. Each channel includes a digital-analog converter having a resistor string to convert digital image data to analog data signal. In the digital-analog converter having the resistor string, the number of resistors, switches, and wirings in the digital-analog converter may exponentially increase as a color depth of the display device increases. Accordingly, a size of the panel driver can be greatly increased.

The above information disclosed in this Background section is only for enhancement of understanding of the background of the disclosure and therefore it may contain information that does not form prior art.

SUMMARY

Aspects of some example embodiments of the present invention relate to display devices. For example, some example embodiments of the present invention relate to a data driver and a display device having the data driver.

Some example embodiments include a data driver capable of being implemented in a relatively small size and driving a high resolution display device.

Some example embodiments included a display device including the data driver.

According to some example embodiments, a data driver may include a ramp signal generator configured to generate a first ramp signal and a second ramp signal of which voltage level is lower than a voltage level of the first ramp signal, a counter configured to generate a count signal by counting a number of clock pulses of a clock signal, and a plurality of channels each configured to generate a data signal corresponding to image data based on the first ramp signal, the second ramp signal, and the count signal. Each of the channels may include a latch circuit configured to divide the image data into a first partial data and a second partial data and configured to latch the first partial data and the second partial data, a duplication driver configured to generate a first reference signal and a second reference signal by duplicating the first ramp signal and the second ramp signal, a digital-analog converter configured to generate a driving signal corresponding to a first partial data based on the first reference signal and the second reference signal, and an output circuit configured to sample the driving signal by comparing the second partial data with the count signal to output the data signal.

In example embodiments, the data driver may further include a ramp driver connected between the ramp signal generator and each of the channels and configured to receive and output the first ramp signal and the second ramp signal.

In example embodiments, the ramp driver may include a first amplifier configured to generate a first pull-up control signal, a first pull-down control signal, and a first ramp driving signal based on the first ramp signal, and a second amplifier configured to generate a second pull-up control signal, a second pull-down control signal, and a second ramp driving signal based on the second ramp signal.

In example embodiments, the duplication driver may include a first reference signal generator configured to generate the first reference signal based on the first pull-up control signal and the first pull-down control signal, and a second reference signal generator configured to generate the second reference signal based on the second pull-up control signal and the second pull-down control signal.

In example embodiments, the first reference signal generator may include a first transistor including a gate electrode configured to receive the first pull-up control signal, a first electrode configured to receive a first power voltage, and a second electrode connected to a first node connected to a first output terminal, and a second transistor including a gate electrode configured to receive the first pull-down control signal, a first electrode configured to receive a second power voltage lower than the first power voltage, and a second electrode connected to the first node.

In example embodiments, the first node may receive the first ramp driving signal.

In example embodiments, the digital-analog converter may include a resistor string configured to distribute the first reference signal and the second reference signal, and a selector configured to select one of voltages distributed by the resistor string as the driving signal based on the first partial data.

In example embodiments, the output circuit may include a sampling controller configured to generate a switch control signal by comparing the second partial data with the count signal, an output buffer configured to output the data signal, and a switch configured to provide the driving signal to the output buffer in response to the switch control signal.

In example embodiments, each of the first ramp signal and the second ramp signal may gradually decrease during a horizontal time. A voltage difference between the first ramp signal and the second ramp signal may be constantly maintained during the horizontal time.

In example embodiments, the first ramp signal may be synchronized to the clock signal. The second ramp signal may correspond to that at least one clock pulse is added to the first ramp signal.

According to some example embodiments, a data driver may include a ramp signal generator configured to generate a ramp signal, a counter configured to generate a count signal by counting a number of clock pulses of a clock signal, and a plurality of channels each configured to generate a data signal corresponding to image data based on the ramp signal and the count signal. Each of the channels may include a latch circuit configured to latch the image data, and an output circuit configured to sample the ramp signal by comparing the latched image data with the count signal to output the data signal.

In example embodiments, the output circuit may include an output buffer configured to output the data signal, a sampling controller configured to generate a sampling signal by comparing the latched image data with the count signal, a level shifter configured to convert the sampling signal to a switch control signal having an on-voltage or an off-voltage, and a switch configured to provide the ramp signal to the output buffer in response to the switch control signal.

In example embodiments, the ramp signal generator may be located between two of the channels.

In example embodiments, the ramp signal generator may include a first ramp signal generating circuit configured to provide a first ramp signal to a first channel group corresponding to red color image data among the plurality of channels, a second ramp signal generating circuit configured to provide a second ramp signal to a second channel group corresponding to green color image data among the plurality of channels, and a third ramp signal generating circuit configured to provide a third ramp signal to a third channel group corresponding to blue color image data among the plurality of channels.

In example embodiments, the ramp signal generator may include a fourth ramp signal generating circuit configured to provide a fourth ramp signal to a fourth channel group corresponding to red color image data or green color image data among the plurality of channels, and a fifth ramp signal generating circuit configured to provide a fifth ramp signal to a fifth channel group corresponding to blue color image data among the plurality of channels.

According to some example embodiments, a display device may include a display panel including a plurality of pixels, a scan driver configured to provide a scan signal to the pixels, and a data driver configured to provide a data signal to the pixels. The data driver may include a ramp signal generator configured to generate a first ramp signal and a second ramp signal of which voltage level is lower than a voltage level of the first ramp signal, a counter configured to generate a count signal by counting a number of clock pulses of a clock signal, and a plurality of channels each configured to generate the data signal corresponding to image data based on the first ramp signal, the second ramp signal, and the count signal. Each of the channels may include a latch circuit configured to divide the image data into a first partial data and a second partial data and configured to latch the first partial data and the second partial data, a duplication driver configured to generate a first reference signal and a second reference signal by duplicating the first ramp signal and the second ramp signal, a digital-analog converter configured to generate a driving signal corresponding to a first partial data based on the first reference signal and the second reference signal, and an output circuit configured to sample the driving signal by comparing the second partial data with the count signal to output the data signal.

In example embodiments, the data driver may further include a ramp driver connected between the ramp signal generator and each of the channels and configured to receive and output the first ramp signal and the second ramp signal.

In example embodiments, the ramp driver may include a first amplifier configured to generate a first pull-up control signal, a first pull-down control signal, and a first ramp driving signal based on the first ramp signal, and a second amplifier configured to generate a second pull-up control signal, a second pull-down control signal, and a second ramp driving signal based on the second ramp signal.

In example embodiments, the duplication driver may include a first reference signal generator configured to generate the first reference signal based on the first pull-up control signal and the first pull-down control signal, and a second reference signal generator configured to generate the second reference signal based on the second pull-up control signal and the second pull-down control signal.

In example embodiments, the first reference signal generator may include a first transistor including a gate electrode configured to receive the first pull-up control signal, a first electrode configured to receive a first power voltage, and a second electrode connected to a first node connected to a first output terminal, and a second transistor including a gate electrode configured to receive the first pull-down control signal, a first electrode configured to receive a second power voltage lower than the first power voltage, and a second electrode connected to the first node. The first node may receive the first ramp driving signal.

Therefore, the data driver according to some example embodiments may be implemented in a relatively small size because the data driver converts image data to data signals based on the ramp signal shared in the plurality of channels.

Also, the data driver according to some example embodiments may be used for driving the display device of which color depth is relatively large by including the digital-analog converter generating the driving signal based on the ramp signal. In this case, because the period of the ramp signal is not excessively shortened, the power consumption of the display device may be reduced. In addition, the data driver includes a ramp driver, and a duplication driver that is included in each channel, thereby reducing a deviation between the channels and enhancing an uniformity of output of each channel.

Further the display device according to some example embodiments may reduce the size of a non-display region on which the panel driver is mounted by including the data driver.

BRIEF DESCRIPTION OF THE DRAWINGS

Aspects of some example embodiments will be described more fully hereinafter with reference to the accompanying drawings, in which various embodiments are shown.

DETAILED DESCRIPTION

Aspects of some example embodiments will be described more fully hereinafter with reference to the accompanying drawings, in which various embodiments are shown.

Figure 1:
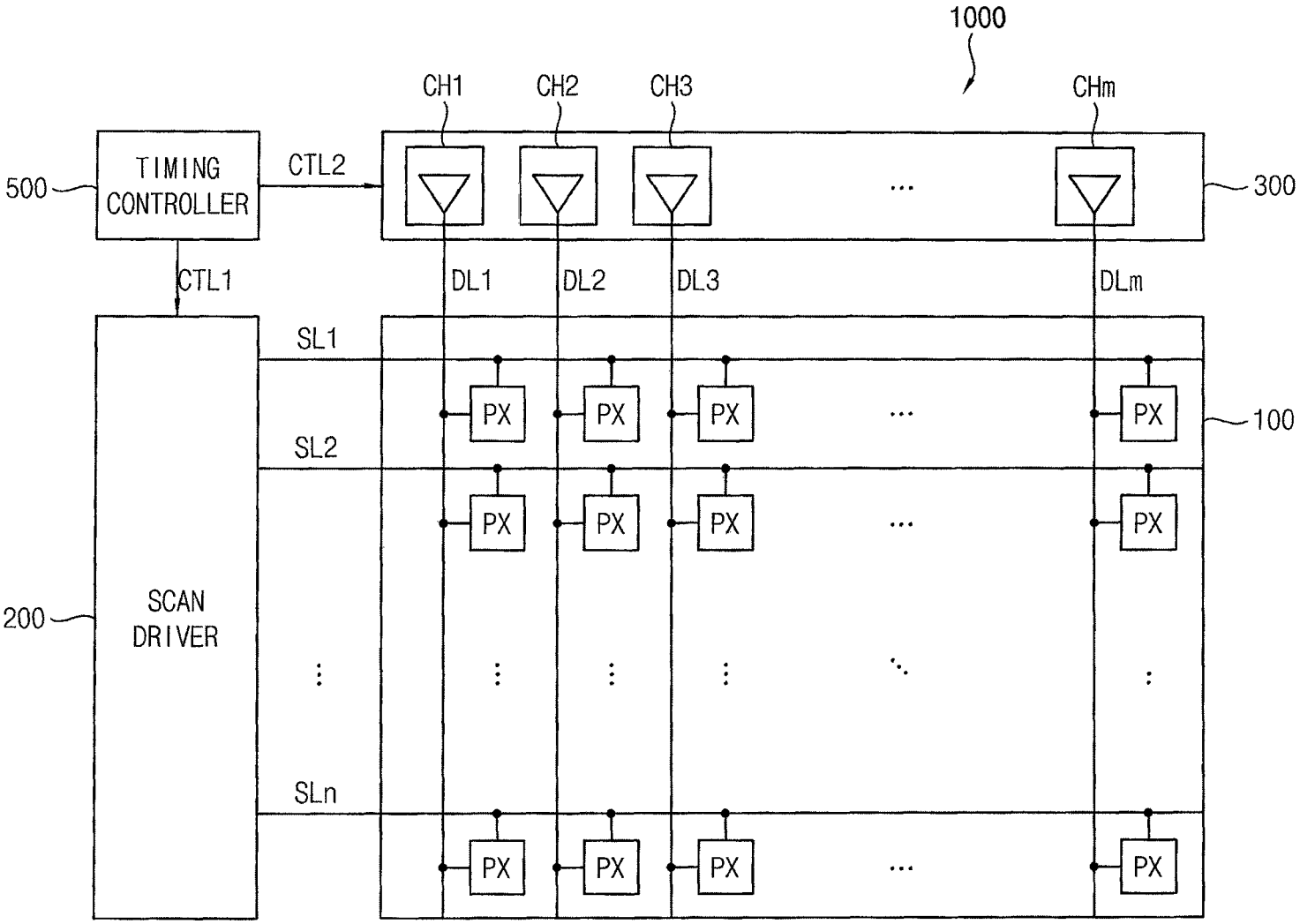
FIG. 1 is a block diagram illustrating a display device according to some example embodiments.

FIG. 1 is a block diagram illustrating a display device according to some example embodiments.

Referring to FIG. 1, the display device 1000 may include a display panel 100, a scan driver 200, a data driver 300, and a timing controller 500.

The display panel 100 may include a plurality of pixels PX. The display panel 100 may be connected to the scan driver 200 via scan lines SL1 through SLn. The display panel 100 may be connected to the data driver 300 via data lines DL1 through DLm. The display panel 100 may include n*m pixels PX because the pixels PX are arranged at locations corresponding to crossing points of the scan lines SL1 through SLn and the data lines DL1 through DLm.

The scan driver 200 may provide the scan signal to the pixels PX via the scan lines SL1 through SLn based on a first control signal CTL1.

The data driver 300 may provide the data signal to the pixels PX via the data lines DL1 through DLm based on a second control signal CTL2. The data driver 300 may include a plurality of channels CH1 through CHm. Each of the channels CH1 through CHm may generate analog driving signal (e.g., the data signal) corresponding to digital image data by sampling a ramp signal and may output the generated data signal to the data lines DL1 through DLm. The ramp signal may be periodically output every time unit (e.g., a horizontal time in which single pixel row is programmed) and may gradually decrease or increase during the time unit.

Each of the channels CH1 through CHm may generate and output the data signal (e.g., analog driving signal) by sampling the ramp signal when a clock count corresponds to a portion of image data (e.g., digital image data). In one example embodiment, the data driver 300 may sample the ramp signal using digital-analog converters in each channel to drive a high resolution display device or a display device of which color depth is relatively large. The data driver 300 may include a ramp driver and duplication drivers, the duplication drivers included in each channel, to reduce a voltage deviation between the channels. In another example embodiment, the data driver 300 may include a ramp signal generator between the channels CH1 through CHm (for example, the center of the channels CH1 through CHm) to reduce a voltage deviation between the channels, and then each channel of the data driver 300 may sample the ramp signal output from the ramp signal generator. The structure of the data driver 300 will be described in detail with reference to FIGS. 2 and 6.

The timing controller 500 may generate the first and second control signals CTL1, CTL2 to control the scan driver 200 and the data driver 300. For example, the first control signal CTL1 for controlling the scan driver 200 include a vertical start signal, clock signals, etc. The second control signal CTL2 for the controlling the data driver 300 may include digital image data, a horizontal start signal, a clock signal, etc.

In addition, the display device 1000 may further include a power supply providing a power source to the display panel 100, the scan driver 200, and the data driver 300.

Figure 2:
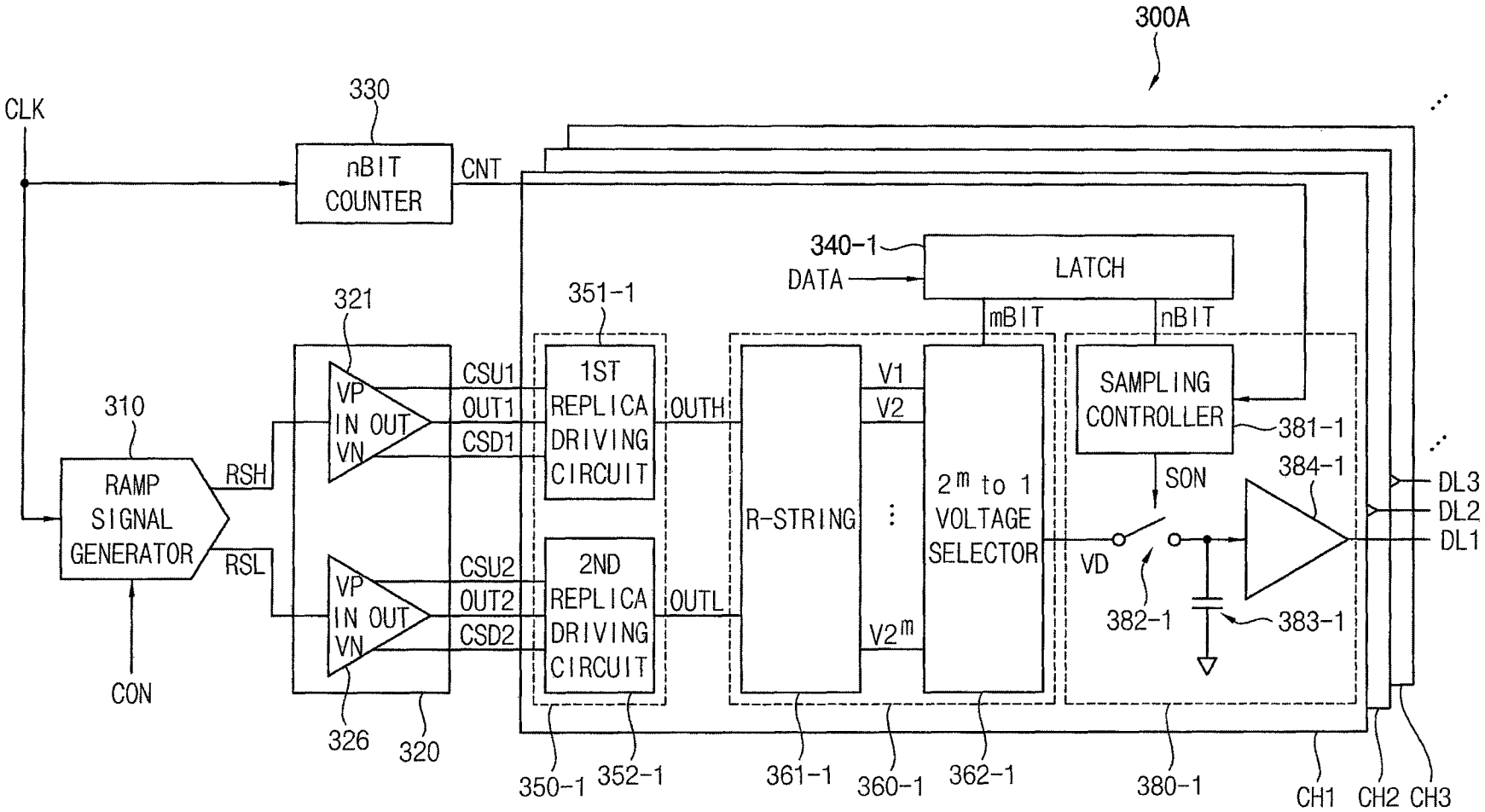
FIG. 2 is a diagram illustrating one example of a data driver included in a display device of FIG. 1.

FIG. 2 is a diagram illustrating one example of a data driver included in a display device of FIG. 1.

Referring to FIG. 2, the data driver 300A may include a ramp signal generator 310, a ramp driver 320, a counter 330, and a plurality of channels CH1, CH2, CH3, etc.

The ramp signal generator 310 periodically generates a first ramp signal RSH and a second ramp signal RSL of which voltage level is lower than a voltage level of the first ramp signal RSH based on a clock signal CLK. Thus, the ramp signal generator 310 may generate the first ramp signal RSH and the second ramp signal RSL to provide an upper reference voltage and a lower reference voltage to the digital-analog converter 360-1 of each channel. In one example embodiment, each of the first ramp signal RSH and the second ramp signal RSL may gradually decrease during each horizontal time. A voltage difference between the first ramp signal RSH and the second ramp signal RSL may be constantly maintained during each horizontal time. In one example embodiment, the first ramp signal RSH may be synchronized to the clock signal CLK. The second ramp signal RSL may correspond to that at least one clock pulse is added to the first ramp signal RSH. The ramp signal generator 310 may be implemented by a resistor string digital-analog converter (R-String DAC) structure to easily generate the first ramp signal RSH and the second ramp signal RSL. However, a structure of ramp signal generator 310 is not limited thereto.

The ramp driver 320 may be connected between the ramp signal generator 310 and each of the channels CH1, CH2, CH3, etc. The ramp driver 320 may receive and output the first ramp signal RSH and the second ramp signal RSL. Thus, the ramp driver 320 may be located between the ramp signal generator 310 and each of the channels CH1, CH2, CH3, etc and may perform a role as a buffer for improving a driving ability. In one example embodiment, the ramp driver 320 may include a first amplifier 321 and a second amplifier 326. The first amplifier 321 may generate a first pull-up control signal CSU1, a first pull-down control signal CSD1, and a first ramp driving signal OUT1 based on the first ramp signal RSH. The second amplifier 326 may generate a second pull-up control signal CSU2, a second pull-down control signal CSD2, and a second ramp driving signal OUT2 based on the second ramp signal RSL.

The counter 330 may to generate a count signal CNT by counting a number of clock pulses of the clock signal CLK. In one example embodiment, the counter 330 may be n-bit counter and may generate the count signal CNT by counting the number of rising edges or falling edges of the clock signal CLK every horizontal period.

Each of the plurality of channels CH1, CH2, CH3, etc may generate the data signal corresponding to image data DATA based on the first ramp signal RSH, the second ramp signal RSL, and the count signal CNT. It is possible to obtain a uniform output of each channel without increasing a size of the channel and without increasing power consumption because a circuit that is the same as the output circuit of the ramp driver 320 is arranged at the front of the digital-analog converter. In one example embodiment, each channel (e.g., the first channel CH1) may include a latch circuit 340-1, a duplication driver 350-1, a digital-analog converter 360-1, and an output circuit 380-1.

The latch circuit 340-1 may divide the image data DATA into a first partial data mBIT and a second partial data nBIT, and may latch the first partial data mBIT and the second partial data nBIT. For example, the latch circuit 340-1 may receive 10 bit image data DATA, may set the first partial data mBIT to the lower 3 bits of the image data DATA, and may set the second partial data nBIT to the upper 7 bits of the image data DATA.

The duplication driver 350-1 may generate a first reference signal OUTH and a second reference signal OUTL by duplicating the first ramp signal RSH and the second ramp signal RSL. In one example embodiment, the duplication driver 350-1 may include a first reference signal generator 351-1 and a second reference signal generator 352-1. The first reference signal generator 351-1 may generate the first reference signal OUTH based on the first pull-up control signal CSU1 and the first pull-down control signal CSD1. The second reference signal generator 352-1 may generate the second reference signal OUTL based on the second pull-up control signal CSU2 and the second pull-down control signal CSD2. For example, the duplication driver 350-1 included in each channel may have substantially the same structure as the output circuit of the ramp driver 320. The structure of the duplication driver 350-1 will be described in detail with reference to FIG. 4.

The digital-analog converter 360-1 may generate a driving signal VD corresponding to a first partial data mBIT based on the first reference signal OUTH and the second reference signal OUTL. Thus, the digital-analog converter 360-1 may receive the first reference signal OUTH as the upper reference voltage and the second reference signal OUTL as the lower reference voltage. The digital-analog converter 360-1 may output the driving signal VD by selecting one of voltages between the upper reference voltage and the lower reference voltage based on the first partial data mBIT (e.g., lower 3 bits of the image data DATA). In one example embodiment, the digital-analog converter 360-1 may include a resistor string 361-1 and a selector 362-1. The resistor string 361-1 may distribute the first reference signal OUTH and the second reference signal OUTL. The selector 362-1 may select one of voltages (e.g., V1 through V$2^m$) distributed by the resistor string 361-1 as the driving signal DV based on the first partial data mBIT.

The output circuit 380-1 may sample the driving signal VD by comparing the second partial data nBIT (e.g., upper 7 bits of image data DATA) with the count signal CNT to output the data signal. Thus, the output circuit 380-1 may output the data signal by sampling the driving signal VD varying according to a time output from the digital-analog converter 360-1 at the timing corresponding to the second partial data nBIT. In one example embodiment, the output circuit 380-1 may include a sampling controller 381-1, a switch 382-1, a capacitor 383-1, and an output buffer 384-1.

The sampling controller 381-1 may generate a switch control signal SON by comparing the second partial data nBIT with the count signal CNT. For example, the sampling controller 381-1 may compare a clock count corresponding to the second partial data nBIT with the count signal CNT such that the switch 382-1 is turned on at a clock count timing corresponding to the second partial data nBIT.

The switch 382-1 may provide the driving signal VD output from the digital-analog converter 360-1 to the output buffer 384-1 in response to the switch control signal SON.

The capacitor 383-1 may be located between an input terminal of the output buffer 384-1 and the ground voltage to reduce a noise.

The output buffer 384-1 may output the data signal to the corresponding data line DL1.

In one example embodiment, the data driver 300A may shut down the duplication driver 350-1 and the digital-analog converter 360-1 when the sampling operation has been completed during a remaining time of the horizontal time to decrease the power consumption. Thus, the duplication driver 350-1 of each channel may operate only in a period in which the sampling operation for the analog voltage is performed, and may shut down in other period, thereby decreasing the power consumption.

Although the example embodiments of FIG. 2 describes that the first ramp signal and the second ramp signal are provided to the duplication driver of each channel through the ramp driver, embodiments of the present invention are not limited thereto. For example, the first ramp signal and the second ramp signal output from the ramp signal generator can be directly provided to the duplication driver of each channel or can be provided a digital-analog converter of each channel through the ramp driver.

The ramp signal generator 310 illustrated in FIG. 2 may be interposed between the channels in order to minimize a voltage deviation between the channels.

Figure 3:
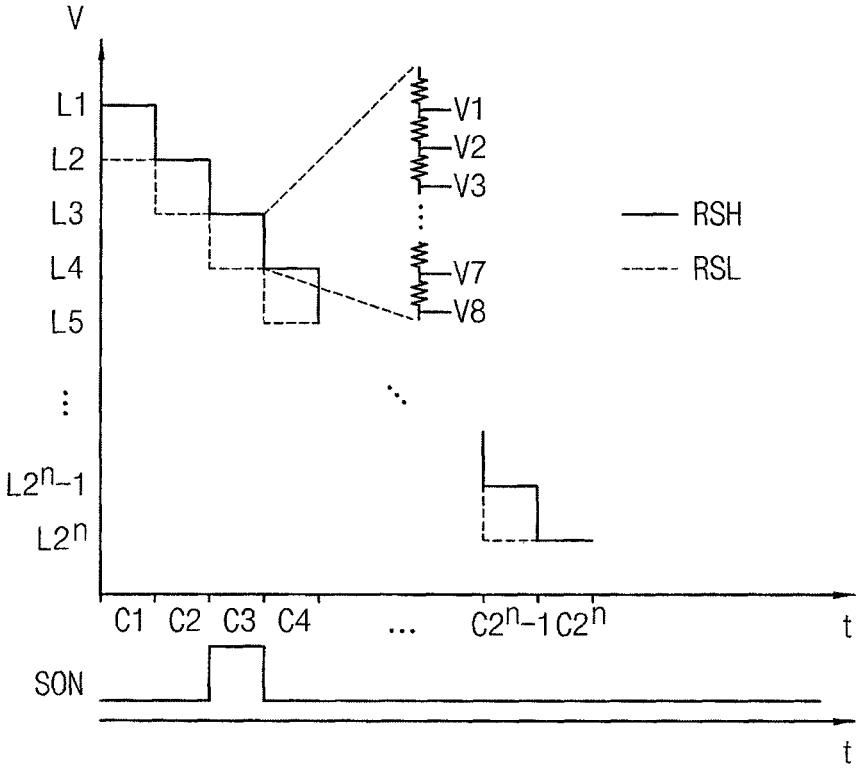
FIG. 3 is a diagram for describing a method of sampling a driving signal by an output circuit included in a data driver of FIG. 2.

FIG. 3 is a diagram for describing a method of sampling a driving signal by an output circuit included in a data driver of FIG. 2.

Referring to FIG. 3, a first ramp signal RSH and a second ramp signal RSL gradually decreasing as a clock count increases may be generated during each horizontal time. In one example embodiment, a voltage difference between the first ramp signal RSH and the second ramp signal RSL may be constantly maintained during each horizontal time. For example, the second ramp signal RSL may correspond to that one clock pulse is added to the first ramp signal RSH. Thus, the second ramp signal RSL may be a signal in which the first ramp signal RSH is shifted by one clock pulse.

In each clock period, a voltage between the first ramp signal RSH and the second ramp signal RSL that are correspond to the first partial data (e.g., the lower 3 bits) of the image data may be selected as the driving signal. The selected driving signal may be output as the data voltage at a timing corresponding to the second partial data (e.g., the upper 7 bits) of the image data.

For example, the first partial data of the image data may correspond to a third voltage V3 among first through eighth voltages V1 through V8 generated by distributing the first ramp signal RSH and the second ramp signal RSL by a digital-analog converter. Also, the second partial data of the image data may correspond to a third clock count period C3. In this case, a switch control signal SON may have on-voltage level in the third clock count period C3. In the third clock count period C3, the first ramp signal RSH may have the third voltage level L3, and the second ramp signal RSL may have the fourth voltage level L4. Accordingly, the third voltage V3 among the first through eighth voltages V1 through V8 between the third voltage level L3 and the fourth voltage level L4 may be output as the data signal, the first through eighth voltages V1 through V8 generated by distributing the first ramp signal RSH and the second ramp signal RSL by a digital-analog converter.

In one example embodiment, the switch control signal SON may be set to an on-voltage level only at a timing corresponding to the second partial data of the image data, and may be set to an off-voltage level during the other period. In this case, unnecessary power consumption for switching of the output buffer may be reduced.

Although the example embodiments of FIG. 3 describe that the first ramp signal and the second ramp signal decrease as the clock count increases during each horizontal period, embodiments of the present invention are not limited thereto. For example, the first ramp signal and the second ramp signal may increase as the clock count increases during each horizontal period.

Figure 4:
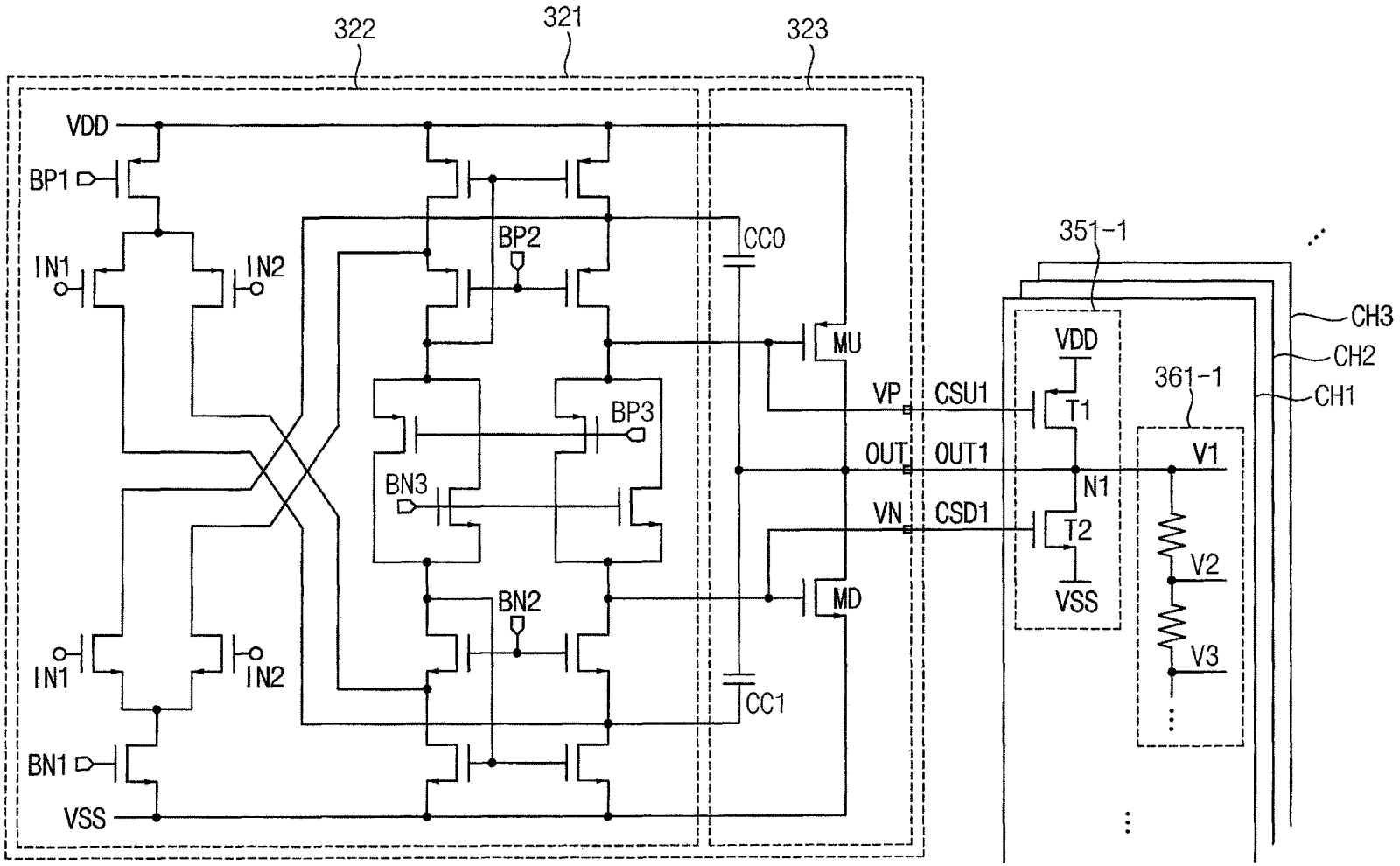
FIG. 4 is a diagram illustrating an example of a ramp driver and a duplication driver included in a data driver of FIG. 2.
Figure 5A:
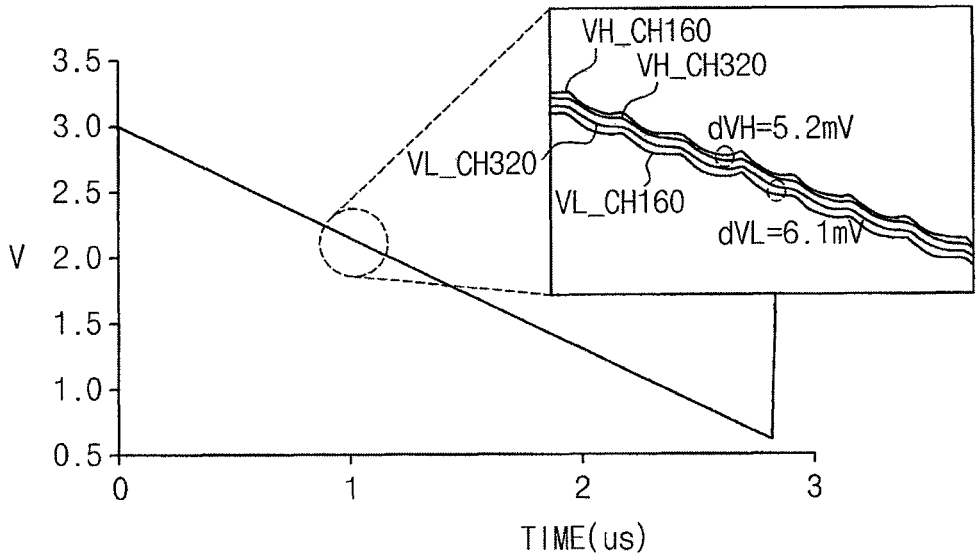
FIGS. 5A and 5B are diagrams for describing an effect of a ramp driver and a duplication driver of FIG. 4.
Figure 5B:
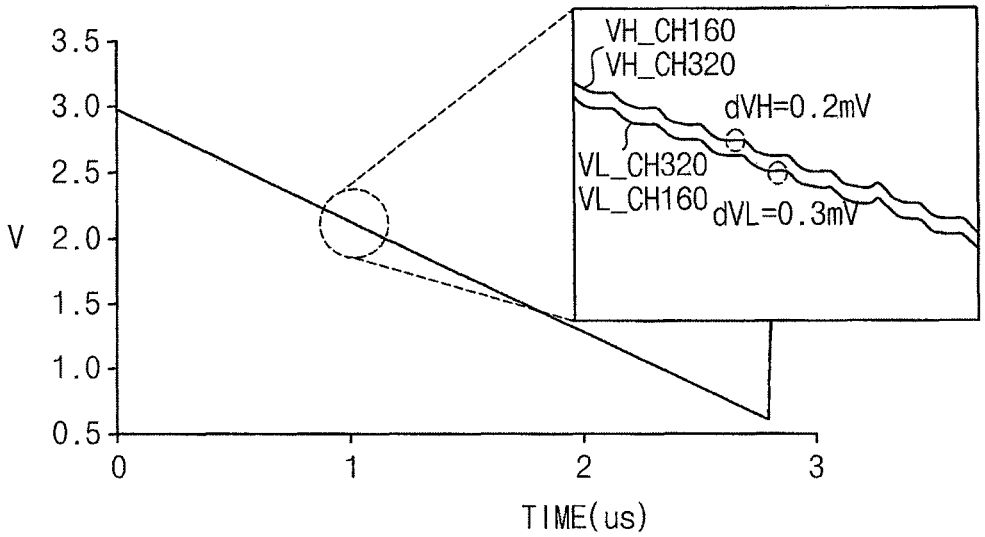

FIG. 4 is a diagram illustrating an example of a ramp driver and a duplication driver included in a data driver of FIG. 2. FIGS. 5A and 5B are diagrams for describing an effect of a ramp driver and a duplication driver of FIG. 4.

Referring to FIGS. 2, 4, 5A, and 5B, the data driver 300A may include a ramp driver 320 and a duplication driver 350-1 to reduce a voltage deviation between the plurality of channels CH1, CH2, CH3, etc. The duplication driver 350-1 may be positioned in each channel.

As shown in FIGS. 2 and 4, the ramp driver 320 may include a first amplifier 321 and a second amplifier 326. The duplication driver 350-1 may include a first reference signal generator 351-1 and a second reference signal generator 352-1. A structure of the second amplifier 326 is substantially the same as a structure of the first amplifier 321. A structure of the second reference signal generator 352-1 is substantially the same as a structure of the first reference signal generator 351-1. Hereinafter, only the first amplifier 321 and the first reference signal generator 351-1 will be described.

The first amplifier 321 may generate a first pull-up control signal CSU1, a first pull-down control signal CSD1, and a first ramp driving signal OUT1 based on the first ramp signal RSH. The first amplifier 321 may perform a role as a buffer for improving a driving ability.

In one example embodiment, the first amplifier 321 may include a folded cascode operational amplifier circuit 322 and an output circuit 323. The folded cascode operational amplifier circuit 322 may have a rail-to-rail input stage structure. The folded cascode operational amplifier circuit 322 may receive input power voltages BP1, BP2, BP3, BN1, BN2, BN3, and may amplify a difference between signals of a first input terminal IN1 and a second input terminal IN2. For example, the first input terminal IN1 may receive the first ramp signal RSH, and the second input terminal IN2 may receive a signal output from an output terminal OUT. The output circuit 323 may include a pull-up transistor MU, a pull-down transistor MD, and compensation capacitors CC0, CC1. The output circuit 323 may amplify the signal output from the folded cascode operational amplifier circuit 322 and may output the amplified signal. Thus, the output circuit 323 may output a first pull-up control signal CSU1 applied to a gate electrode of the pull-up transistor MU to the pull-up control terminal VP. The output circuit 323 may output a first pull-down control signal CSD1 applied to a gate electrode of the pull-down transistor MD to the pull-down control terminal VN. The output circuit 323 may output a first lamp driving signal OUT1 to the output terminal OUT.

The first reference signal generator 351-1 included in each channel may be implemented as a duplication driver having a simple structure to solve the problem related to a voltage deviation between channels, efficiently. The first reference signal generator 351-1 may have a circuit structure similar to the output circuit 323 of the first amplifier 321. In one example embodiment, the first reference signal generator 351-1 may include a first transistor T1 and a second transistor T2. The first transistor T1 and the second transistor T2 may perform the same operation as the pull-up transistor MU and the pull-down transistor TD of the first amplifier 321. The first transistor T1 may include a gate electrode receiving the first pull-up control signal CSU1, a first electrode receiving a first power voltage VDD, and a second electrode connected to a first node N1. The first node N1 may be connected to a first output terminal to which a first reference signal OUTH. The second transistor T2 may include a gate electrode receiving the first pull-down control signal CSD1, a first electrode receiving a second power voltage lower VSS than the first power voltage, and a second electrode connected to the first node N1. The first node N1 may receive the first ramp driving signal OUT1.

Although the example embodiments of FIG. 4 describe that the first amplifier and the second amplifier are Class AB type amplifiers, the first amplifier and the second amplifier may be implemented with various structures performing a buffer role.

As shown in FIGS. 5A and 5B, the data driver 300A includes 320 channels, and the ramp signal generator is disposed at the center of the channels. In this situation, a deviation between the ramp signals applied to the digital-to-analog converters was measured.

In FIG. 5A, when the duplication driver 350-1 is not included in each channel and the ramp signal is directly applied to the digital-to-analog converter, a voltage difference between a ramp signal applied to a center channel and a ramp signal applied to an edge channel occurred. Here, the center channel indicates a channel (e.g., the (160)th channel) located at the center of channels. The edge channel indicates a channel (e.g., the (320)th channel) located at the edge of channels. Thus, the voltage deviation dVH between the first ramp signal VH_CH160 applied to the (160)th channel and the first ramp signal VH_CH320 applied to the (320)th channel was about 5.2 mV. In addition, a voltage difference dVL between the second ramp signal VL_CH160 applied to the (160)th channel and the second ramp signal VL_CH320 applied to the (320)th channel was about 6.1 mV.

On the other hand, in FIG. 5B, when the duplication driver 350-1 is included in each channel, the voltage difference dVH between the first ramp signal VH_CH160 applied to the (160)th channel and the first ramp signal VH_CH320 applied to the (320)th channel was about 0.2 mV. In addition, a voltage difference dVL between the second ramp signal VL_CH160 applied to the (160)th channel and the second ramp signal VL_CH320 applied to the (320)th channel was about 0.3 mV.

Figure 6:
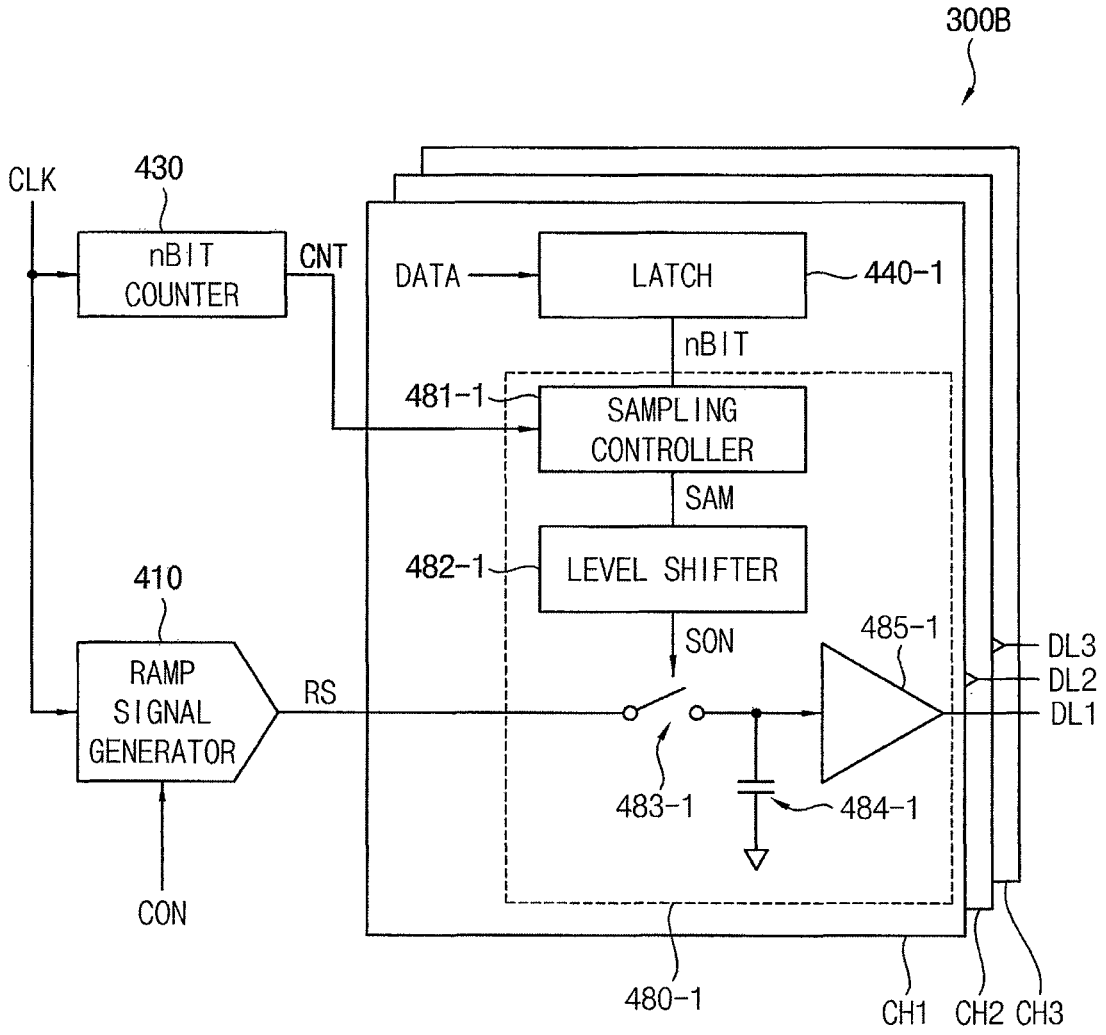
FIG. 6 is a diagram illustrating another example of a data driver included in a display device of FIG. 1.

Therefore, each channel of the data driver 300A may include the duplication driver 350-1 to reduce the deviation of the ramp voltages applied to the channels FIG. 6 is a diagram illustrating another example of a data driver included in a display device of FIG. 1.

Referring to FIG. 6, the data driver 300B may include a ramp signal generator 410, a counter 430, and a plurality of channels CH1, CH2, CH3, etc.

The ramp signal generator 410 may periodically generate a ramp signal RS. The ramp signal generator 410 may provide the generated ramp signal RS to output buffer included in each channel through a switch. In one example embodiment, the ramp signal RS may gradually decrease during each horizontal time. In one example embodiment, the ramp signal generator 410 may receive a ramp control signal CON, and may control a voltage of the ramp signal RS to be output as the data signal based on the ramp control signal CON. Accordingly, the ramp signal generator 410 may adjust a voltage and a slope of the ramp signal RS according to a grayscale accuracy (e.g., color depth), resolution, and target luminance of the display device and may output the adjusted ramp signal RS.

The counter 430 may generate a count signal CNT by counting a number of clock pulses of a clock signal CLK. In one example embodiment, the counter 430 may be n-bit counter and may generate the count signal CNT by counting the number of rising edges or falling edges of the clock signal CLK every horizontal period.

Each of the plurality of channels CH1, CH2, CH3, etc. may generate the data signal corresponding to image data DATA based on the ramp signal RS and the count signal CNT and may output the generated data signal to the corresponding data line. Each channel (e.g., the first channel CH1) may include a latch circuit 440-1 and an output circuit 480-1.

The latch circuit 340-1 may latch the image data DATA.

The output circuit 480-1 may sample the ramp signal RS by comparing the n bits latched image data nBIT with the count signal CNT. Thus, the output circuit 480-1 may output the data signal by sampling the ramp signal RS varying according to a time at the timing corresponding to the latched image data. In one example embodiment, the output circuit 480-1 may include a sampling controller 481-1, a level shifter 482-1, a switch 483-1, a capacitor 484-1, and an output buffer 485-1.

The sampling controller 481-1 may generate a sampling signal SAM by comparing the latched image data nBIT with the count signal CNT. The level shifter 482-1 may convert the sampling signal SAM to a switch control signal SON having an on-voltage or an off-voltage. Thus, the sampling controller 481-1 may compare a clock count corresponding to the latched image data nBIT with the count signal CNT such that the switch 483-1 is turned on at a clock count timing corresponding to the latched image data nBIT.

The switch 483-1 may provide the ramp signal RS to the output buffer 485-1 in response to the switch control signal SON. The capacitor 484-1 may be located between an input terminal of the output buffer 485-1 and the ground voltage to reduce a noise. The output buffer 485-1 may output the data signal to the corresponding data line DL1.

In one example embodiment, an additional switch (not shown) may be located at the front of the input terminal of the output buffer 485-1 to reduce unnecessary power consumption for switching of the output buffer 485-1. In this case, it is possible to control the output buffer 485-1 to output the data signal only at the sampling time.

Therefore, all the channels of the data driver 300B may generate the data signal using the ramp signal RS output from the ramp signal generator 410. Because area of the data driver 300B does not exponentially increase as the color depth increases, the data driver 300B can be implemented in a relatively small size. For example, the data driver 300B according to example embodiments may have a size reduced by about 35% compared to the DAC-based data driver including the resistor string.

Figure 7:
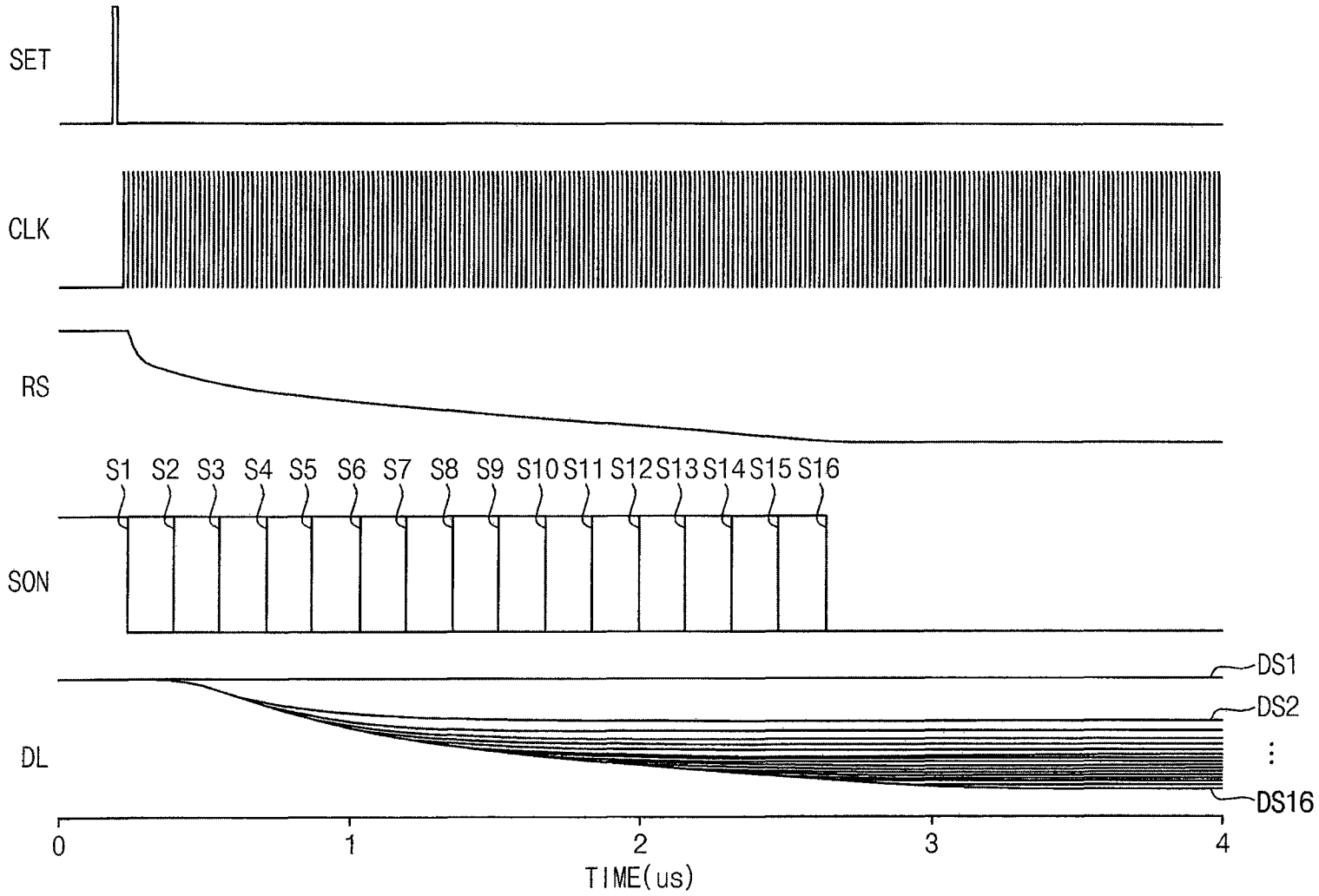
FIG. 7 is a diagram for describing a method of sampling a ramp signal by an output circuit included in a data driver of FIG. 6.

FIG. 7 is a diagram for describing a method of sampling a ramp signal by an output circuit included in a data driver of FIG. 6.

Referring to FIG. 7, the data driver may convert the digital image data to the analog data signal by sampling the ramp signal RS which gradually decreases within each horizontal period at a timing corresponding to the image data.

For example, the initialization setting signal SET is set, and then the counter may initialize the count signal. When the switch control signal SON is set from the on-voltage to the off-voltage at each of first through the sixteenth timings S1 through S16 that are different from each other as time passes, the first through sixteenth data signals DS1 through DS16 may be output to the data line. Accordingly, the digital image data may be converted to the analog data signal by setting the switch control signal SON to the on voltage level at a timing corresponding to the image data.

Figure 8:
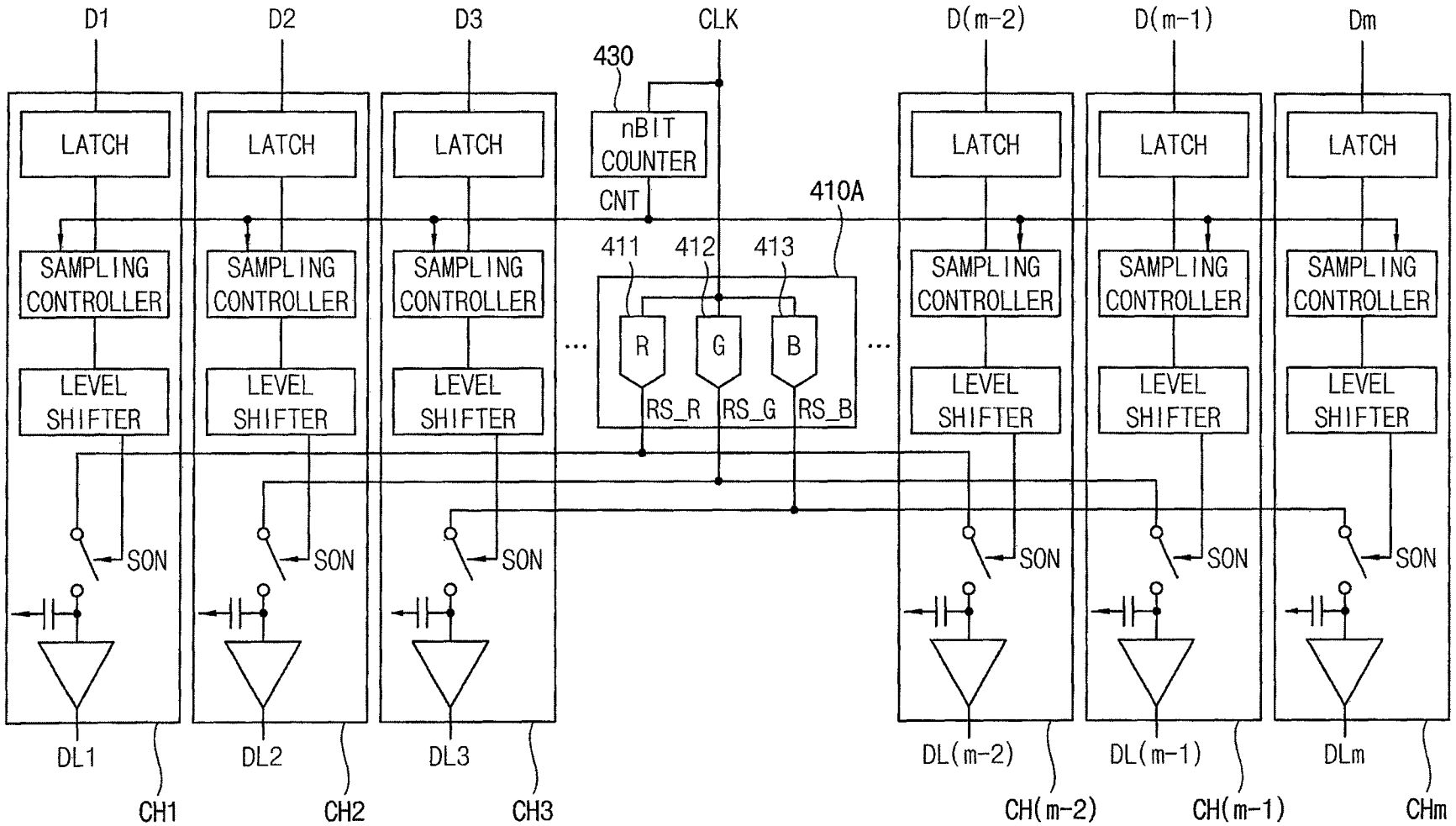
FIGS. 8 and 9 are diagrams illustrating examples in which a ramp signal generator included in a data driver of FIG. 6 is arranged.
Figure 9:
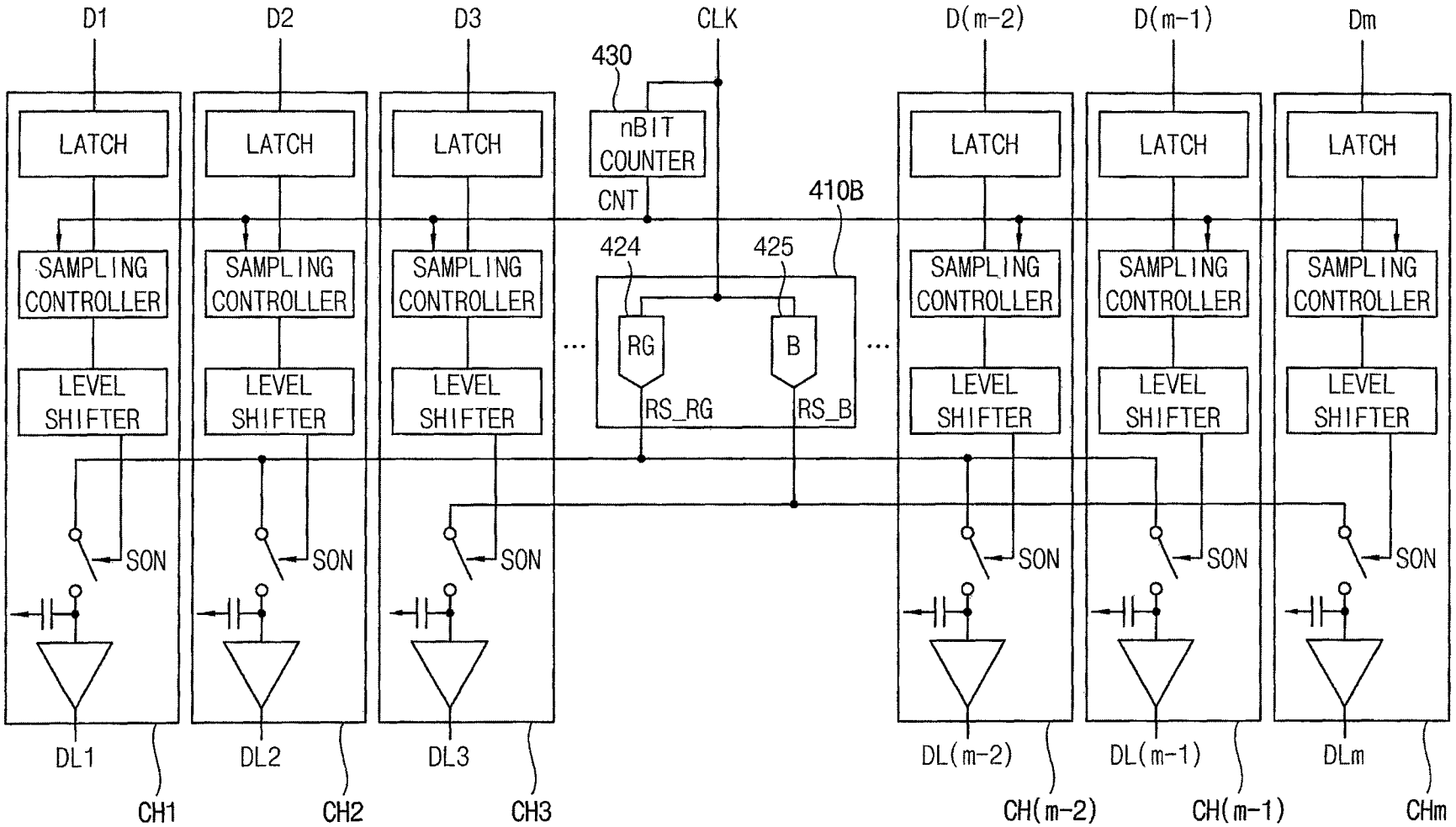

FIGS. 8 and 9 are diagrams illustrating examples in which a ramp signal generator included in a data driver of FIG. 6 is arranged.

Referring to FIGS. 8 and 9, the ramp signal generator 410A, 410B may be disposed between channels. In one example embodiment, the ramp signal generator 410A, 410B may be disposed between first through (m)th channels CH1 through CHm in order to minimize a deviation of ramp voltages applied to the channels, where m is an integer greater than 1. For example, the ramp signal generator 410A, 410B may be located at the center of the area in which the channels are arranged (e.g., between the (2/m)th channel and the (2/m+1)th channel).

The ramp signal generator 410A, 410B may provide different ramp signals according to the color of the image data.

In one example embodiment, as shown in FIG. 8, the ramp signal generator 410A may include a first ramp signal generating circuit 411, a second ramp signal generating circuit 412, and a third ramp signal generating circuit 413. The first ramp signal generating circuit 411 may provide a first ramp signal RS-R to a first channel group (e.g., the first channel CH1, the (m−2) channel CH(m−2), etc) corresponding to red color image data (e.g., D1, D(m−2)). The second ramp signal generating circuit 412 may provide a second ramp signal RS-G to a second channel group (e.g., the second channel CH2, the (m−1)th channel CH(m−1), etc) corresponding to green color image data (e.g., D2, D(m−1)). The third ramp signal generating circuit 413 provide a third ramp signal RS-B to a third channel group (e.g., the third channel CH3, the (m)th channel CHm, etc) corresponding to blue color image data (e.g., D3, Dm). For example, in an organic light emitting display device in which deviations of a red color gamma voltage, a green color gamma voltage, and a blue color gamma voltage are relatively large, the image data may be converted to data signals using different ramp signals depending on the color of image data.

In another example embodiment, as shown in FIG. 9, the ramp signal generator 410B may include a fourth ramp signal generating circuit 414 and a fifth ramp signal generating circuit 415. The fourth ramp signal generating circuit 414 may provide a fourth ramp signal RS-RG to a fourth channel group (e.g., the first channel CH1, the second channel CH2, the (m−2)th channel CH(m−2), the (m−1) channel CH(m−1), etc) corresponding to red color image data or green color image data. The fifth ramp signal generating circuit 415 may provide a fifth ramp signal RS-B to a fifth channel group (e.g., the third channel CH3, the (m)th channel CHm, etc) corresponding to blue color image data. For example, in the organic light emitting display device in which a deviation between a red color gamma voltage and a green color gamma voltage is relatively small, the red color image data and the green color image data may be converted to the data signal using the same ramp signal.

Although the example embodiments of FIGS. 8 and 9 describe that the display device is an organic light emitting display device of RGB type including red color pixels, green color pixels, and blue color pixels, embodiments of the present invention are not limited thereto. For example, the display device may be an organic light emitting display device of RGBW type further including white color pixels. In this case, a ramp signal generating circuit providing another ramp signal for white color image data may be added, or the white image data may be converted into the data signal using the same ramp signal as the blue color image data because a deviation between the blue color gamma voltage and the white color gamma voltage is relatively small.

Although a data driver and a display device having the data driver according to example embodiments have been described with reference to figures, those skilled in the art will readily appreciate that many modifications are possible in the example embodiments without materially departing from the novel teachings and aspects of embodiments of the present invention. For example, although the example embodiments describe that the display device is organic light emitting display device, a configuration of the display device is not limited thereto.

Aspects of example embodiments of the present invention may include an electronic device having the display device.

For example, embodiments of the present invention may include a personal computer, laptop computer, a cellular phone, a smart phone, a smart pad, a personal digital assistant (PDA), etc.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

The foregoing is illustrative of example embodiments and is not to be construed as limiting thereof. Although a few example embodiments have been described, those skilled in the art will readily appreciate that many modifications are possible in the example embodiments without materially departing from the novel teachings and aspects of embodiments of the present invention. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A data driver comprising:

a ramp signal generator configured to generate a first ramp signal and a second ramp signal such that a voltage level of the second ramp signal is lower than a voltage level of the first ramp signal;

a counter configured to generate a count signal by counting a number of clock pulses of a clock signal; and a plurality of channels each configured to generate a data signal corresponding to image data based on the first ramp signal, the second ramp signal, and the count signal, wherein each of the channels includes:

a latch circuit configured to divide the image data into a first partial data and a second partial data and configured to latch the first partial data and the second partial data;

a duplication driver configured to generate a first reference signal and a second reference signal by duplicating the first ramp signal and the second ramp signal;

a digital-analog converter configured to generate a driving signal corresponding to a first partial data based on the first reference signal and the second reference signal; and an output circuit configured to sample the driving signal by comparing the second partial data with the count signal to output the data signal.

2. The data driver of claim 1, further comprising:

a ramp driver connected between the ramp signal generator and each of the channels and configured to receive and output the first ramp signal and the second ramp signal.

3. The data driver of claim 2, wherein the ramp driver comprises:

a first amplifier configured to generate a first pull-up control signal, a first pull-down control signal, and a first ramp driving signal based on the first ramp signal; and a second amplifier configured to generate a second pull-up control signal, a second pull-down control signal, and a second ramp driving signal based on the second ramp signal.

4. The data driver of claim 3, wherein the duplication driver comprises:

a first reference signal generator configured to generate the first reference signal based on the first pull-up control signal and the first pull-down control signal; and a second reference signal generator configured to generate the second reference signal based on the second pull-up control signal and the second pull-down control signal.

5. The data driver of claim 4, wherein the first reference signal generator comprises:

a first transistor including a gate electrode configured to receive the first pull-up control signal, a first electrode configured to receive a first power voltage, and a second electrode connected to a first node connected to a first output terminal; and a second transistor including a gate electrode configured to receive the first pull-down control signal, a first electrode configured to receive a second power voltage lower than the first power voltage, and a second electrode connected to the first node.

6. The data driver of claim 5, wherein the first node is configured to receive the first ramp driving signal.

7. The data driver of claim 1, wherein the digital-analog converter comprises:

a resistor string configured to distribute the first reference signal and the second reference signal; and a selector configured to select one of voltages distributed by the resistor string as the driving signal based on the first partial data.

8. The data driver of claim 1, wherein the output circuit comprises:

a sampling controller configured to generate a switch control signal by comparing the second partial data with the count signal;

an output buffer configured to output the data signal; and a switch configured to provide the driving signal to the output buffer in response to the switch control signal.

9. The data driver of claim 1, wherein each of the first ramp signal and the second ramp signal gradually decreases during a horizontal time, and wherein a voltage difference between the first ramp signal and the second ramp signal is constantly maintained during the horizontal time.

10. The data driver of claim 9, wherein the first ramp signal is synchronized to the clock signal, and wherein the second ramp signal corresponds to that at least one clock pulse is added to the first ramp signal.

11. A display device comprising:

a display panel including a plurality of pixels;

a scan driver configured to provide a scan signal to the pixels; and a data driver configured to provide a data signal to the pixels, wherein the data driver includes:

a ramp signal generator configured to generate a first ramp signal and a second ramp signal of which voltage level is lower than a voltage level of the first ramp signal;

a counter configured to generate a count signal by counting a number of clock pulses of a clock signal; and a plurality of channels each configured to generate the data signal corresponding to image data based on the first ramp signal, the second ramp signal, and the count signal, wherein each of the channels includes:

a latch circuit configured to divide the image data into a first partial data and a second partial data and configured to latch the first partial data and the second partial data;

a duplication driver configured to generate a first reference signal and a second reference signal by duplicating the first ramp signal and the second ramp signal;

a digital-analog converter configured to generate a driving signal corresponding to a first partial data based on the first reference signal and the second reference signal; and an output circuit configured to sample the driving signal by comparing the second partial data with the count signal to output the data signal.

12. The display device of claim 11, wherein the data driver further comprises:

a ramp driver connected between the ramp signal generator and each of the channels and configured to receive and output the first ramp signal and the second ramp signal.

13. The display device of claim 12, wherein the ramp driver comprises:

a first amplifier configured to generate a first pull-up control signal, a first pull-down control signal, and a first ramp driving signal based on the first ramp signal; and a second amplifier configured to generate a second pull-up control signal, a second pull-down control signal, and a second ramp driving signal based on the second ramp signal.

14. The display device of claim 13, wherein the duplication driver comprises:

a first reference signal generator configured to generate the first reference signal based on the first pull-up control signal and the first pull-down control signal; and a second reference signal generator configured to generate the second reference signal based on the second pull-up control signal and the second pull-down control signal.

15. The display device of claim 14, wherein the first reference signal generator comprises:

a first transistor including a gate electrode configured to receive the first pull-up control signal, a first electrode configured to receive a first power voltage, and a second electrode connected to a first node connected to a first output terminal; and a second transistor including a gate electrode configured to receive the first pull-down control signal, a first electrode configured to receive a second power voltage lower than the first power voltage, and a second electrode connected to the first node, and wherein the first node is configured to receive the first ramp driving signal.

* * * * *